US009730479B2

(12) United States Patent
Lewis et al.

(10) Patent No.: US 9,730,479 B2
(45) Date of Patent: Aug. 15, 2017

(54) INSULATING APPAREL

(71) Applicant: WORK WARM, Mt. Pleasant, UT (US)

(72) Inventors: Dale H. Lewis, Spring City, UT (US); Don E. Thomason, South Jordan, UT (US)

(73) Assignee: AERIS, Mt. Pleasant, UT (US)

( * ) Notice: Subject to any disclaimer, the term of this patent is extended or adjusted under 35 U.S.C. 154(b) by 516 days.

(21) Appl. No.: 14/174,737

(22) Filed: Feb. 6, 2014

(65) Prior Publication Data

US 2014/0215697 A1 Aug. 7, 2014

Related U.S. Application Data

(60) Provisional application No. 61/761,634, filed on Feb. 6, 2013.

(51) Int. Cl.

| | |
|---|---|
| ***A62B 17/00*** | (2006.01) |
| ***A41D 31/00*** | (2006.01) |
| ***A41D 3/00*** | (2006.01) |

(52) U.S. Cl.

CPC ..... *A41D 31/0038* (2013.01); *A41D 3/00* (2013.01)

(58) Field of Classification Search

CPC .... A41D 31/0038; A41D 3/00; H04L 5/0035; H04L 5/0048; H04B 17/24; H04B 14/309; H04B 17/336; H04B 17/309; H04B 17/382; H04B 7/024; H04W 48/20; H04W 72/0406; H04W 72/082; H04W 72/085; A62B 17/00

USPC ..... 2/458

See application file for complete search history.

(56) References Cited

U.S. PATENT DOCUMENTS

| | | | |
|---|---|---|---|
| 3,665,968 | A | 5/1972 | De Putter |
| 4,742,580 | A | 5/1988 | Phillips, Jr. et al. |
| 4,777,186 | A | 10/1988 | Stang et al. |
| 4,787,105 | A | 11/1988 | Phillips et al. |
| 4,823,407 | A | 4/1989 | Phillips, Jr. et al. |
| 4,843,647 | A | 7/1989 | Phillips, Sr. et al. |
| 4,845,862 | A | 7/1989 | Phillips, Jr. et al. |
| 4,887,317 | A | 12/1989 | Phillips, Sr. et al. |
| 4,951,319 | A | 8/1990 | Phillips, Jr. et al. |
| 5,183,299 | A | 2/1993 | Hallerstrom et al. |
| 5,699,632 | A | 12/1997 | Stout et al. |
| 5,981,020 | A | 11/1999 | Sutherland et al. |
| 6,376,068 | B1 | 4/2002 | Garcia-Ramirez et al. |

(Continued)

FOREIGN PATENT DOCUMENTS

WO 2006002440 A2 1/2006

OTHER PUBLICATIONS

U.S. Appl. No. 14/174,739 Office Action dated Nov. 5, 2014.

(Continued)

*Primary Examiner* — Arti Singh-Pandey
(74) *Attorney, Agent, or Firm* — Kunzler Law Group, PC

(57) ABSTRACT

Articles of apparel and a method for manufacturing an article of apparel are disclosed. An insulation layer for an article of apparel may include a flexible polyurethane foam. The foam may be generated by polymerization in a pressurizable chamber at a pressure sufficient to prevent the foam from completely filling the chamber. A shell layer may include wind resistant, breathable material. The shell layer may include an outer layer of the article of apparel.

6 Claims, 4 Drawing Sheets

(56) References Cited

U.S. PATENT DOCUMENTS

| | | | | |
|---|---|---|---|---|
| 7,207,527 | B2 | 4/2007 | Opperthauser | |
| 7,407,197 | B2 | 8/2008 | Gronquist | |
| 7,559,343 | B1 | 7/2009 | Vujic et al. | |
| 8,087,432 | B2 | 1/2012 | Rudi et al. | |
| 2006/0057918 | A1 | 3/2006 | Burnett | |
| 2006/0216492 | A1 | 9/2006 | Thomson | |
| 2009/0077710 | A1* | 3/2009 | Bay | A41D 27/28 2/87 |
| 2009/0209155 | A1 | 8/2009 | Goulet | |
| 2011/0011601 | A1 | 1/2011 | Ono et al. | |
| 2012/0040138 | A1 | 2/2012 | Weidinger et al. | |

OTHER PUBLICATIONS

Notice of Allowance mailed Mar. 5, 2015 for U.S. Appl. No. 14/174,739.

Phillips, Thermal Johns (Tj's), http://www.jimsway.com/atjs1.html, Received Jan. 9, 2013, Retrieved Feb. 10, 2014.

Phillips, The PALS History—Clothing 2200, Phillips Arctic Living System, http://www.youtube.com/watch?v=SxqV8FgLZeg &feature=relmfu, Nov. 2, 2012.

PCT/US2014/015178 International Search Report and Written Opinion mailed May 23, 2014.

* cited by examiner

INSULATING APPAREL

CROSS-REFERENCE TO RELATED APPLICATION

This application claims the benefit of U.S. Provisional Patent Application No. 61/761,634, entitled "INSULATING APPAREL" and filed on Feb. 6, 2013 for Dale H. Lewis et al., which is incorporated herein by reference.

FIELD

The present disclosure, in various embodiments, relates to apparel and more particularly relates to insulating apparel.

BACKGROUND

People use insulating material in many environments to protect themselves against heat or cold. Often, this insulating material is worn as clothing for work or recreation. For example, insulating gloves may protect a welder's hands from heat and slag. Likewise, an insulating jacket may protect a wearer from cold weather for extended outdoor recreation. Many types of insulating apparel are available, such as hats, gloves, mittens, socks, shoes, boots, pants, shirts, coats, jackets, overalls, coveralls, and the like.

Although insulating clothing may protect a wearer from extreme temperatures, some types of insulating apparel also tend to trap moisture near a wearer. Moisture from rain, snow, perspiration, or the like, is likely to accumulate in the apparel over time. In a cold environment, trapped moisture conducts heat away from the wearer, causing discomfort or pain. If heat conduction through the trapped moisture continues, a wearer may experience dangerous conditions, such as hypothermia or frostbite.

Some insulating clothing includes a waterproof, but breathable, outer layer, which prevents moisture derived from rain or snow from entering the garment, while allowing water vapor from light perspiration to escape. However, a waterproof, but breathable, outer layer naturally transmits water molecules slowly, and may still trap moisture from heavier perspiration near the wearer's skin. Thus, a person engaging in more strenuous activity, often typical of prolonged cold-weather work or recreation, may still become wet, cold, and uncomfortable.

SUMMARY

The subject matter of the present disclosure has been developed in response to the present state of the art, and in particular, in response to the problems and needs of wearers of insulating apparel that have not yet been fully solved by currently available clothing. Accordingly, the subject matter of the present application has been developed to provide insulating apparel that overcomes many of the shortcomings of the prior art.

An article of apparel is disclosed. In one embodiment, an insulation layer includes a flexible polyurethane foam. In a further embodiment, the foam is generated by polymerization in a pressurizable chamber at a pressure sufficient to prevent the foam from completely filling the chamber. In a certain embodiment, a shell layer includes wind resistant, breathable material. In a further embodiment, the shell layer includes an outer layer of the article of apparel.

In one embodiment, the article of apparel includes an inner lining layer. In a further embodiment, the insulation layer is disposed between the inner lining layer and the shell layer. In a certain embodiment, the inner lining layer includes mesh fabric. In another embodiment, the inner lining layer, the insulation layer, and the shell layer are quilted together.

In one embodiment, a moisture vapor transmission rate ("MVTR") of the insulation layer is approximately 1,150 $g/m^2/24$ hrs. In another embodiment, a MVTR of the insulation layer is in a range from approximately 900 $g/m^2/24$ hrs to approximately 1,200 $g/m^2/24$ hrs. In a further embodiment, a thickness of the insulation layer when uncompressed is within a range of approximately ¼ inch to approximately 1 inch. In a certain embodiment, an indentation load deflection ("ILD") of the insulation layer is in a range from approximately 10.0 lbs/50 $in^2$ to approximately 32.0 lbs/50 $in^2$. In some embodiments, a density of the insulation layer is in a range from approximately 1.1 $lbs/ft^3$ to approximately 1.65 $lbs/ft^3$.

Another article of apparel is disclosed. In one embodiment, an insulation layer includes foam material. In a further embodiment, a shell layer includes wind-resistant, breathable material disposed over the insulation layer. In a certain embodiment, a fire protection layer includes fire retardant material, heat resistant material, and/or flameproof material.

In one embodiment, the foam material is generated by polymerization in a pressurizable chamber at a pressure sufficient to prevent the foam material from completely filling the chamber. In a certain embodiment, the fire protection layer includes oxidized polyacrylonitrile fibers.

In one embodiment, the article of apparel includes an inner lining layer. In a further embodiment, the insulation layer is disposed between the inner lining layer and the shell layer. In a certain embodiment, the inner lining layer includes mesh fabric. In another embodiment, the inner lining layer, the insulation layer, the shell layer, and the fire protection layer are quilted together.

In one embodiment, a MVTR of the insulation layer is approximately 1,150 $g/m^2/24$ hrs. In another embodiment, a MVTR of the insulation layer is in a range from approximately 900 $g/m^2/24$ hrs to approximately 1,200 $g/m^2/24$ hrs. In a further embodiment, a thickness of the insulation layer when uncompressed is within a range of approximately ¼ inch to approximately 1 inch. In a certain embodiment, an ILD of the insulation layer is in a range from approximately 10.0 lbs/50 $in^2$ to approximately 32.0 lbs/50 $in^2$.

A method is disclosed for manufacturing an article of apparel. In one embodiment, the method includes providing an insulation layer for an article of apparel. In a certain embodiment, the insulation layer includes flexible polyurethane foam. In a further embodiment, the foam is generated by polymerization in a pressurizable chamber at a pressure sufficient to prevent the foam from completely filling the chamber. In certain embodiments, cells of the foam trap air and allow moisture transfer through the insulation layer. In further embodiments, the method includes attaching a shell layer to the outside of the insulation layer. In some embodiments, the shell layer includes wind resistant, breathable material.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the disclosure will be described and explained with additional specificity and detail through the use of the accompanying drawings, in which.

DETAILED DESCRIPTION

Figure 1:
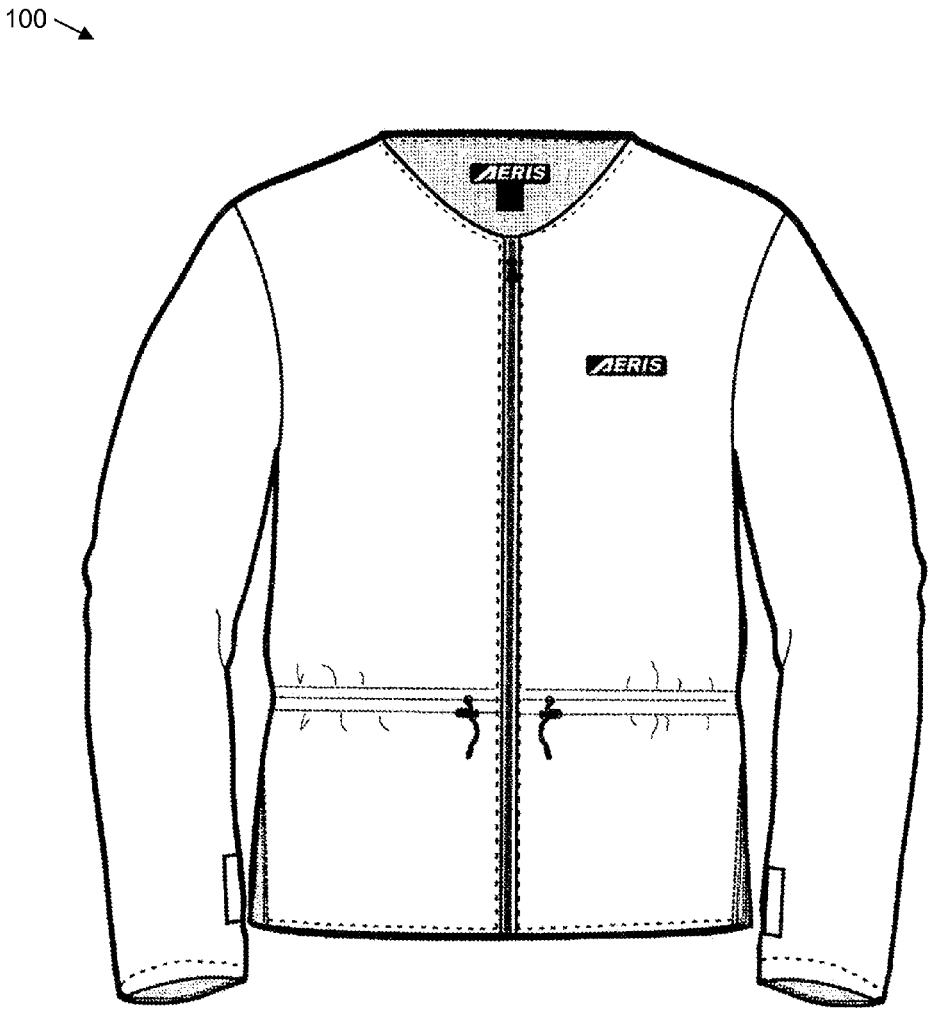
FIG. 1 is a perspective view illustrating one embodiment of an article of apparel

FIG. 1 depicts one embodiment of an article of apparel 100. In various embodiments, the article of apparel 100 includes an insulation layer as described below with regard to FIG. 2 and FIG. 3. In the depicted embodiment, the article of apparel 100 is a jacket; however, in other embodiments, the article of apparel 100 may include a hat, glove, mitten, sock, shoe, boot, pants, shirt, coat, jacket, overalls, coveralls, or the like.

Figure 2:
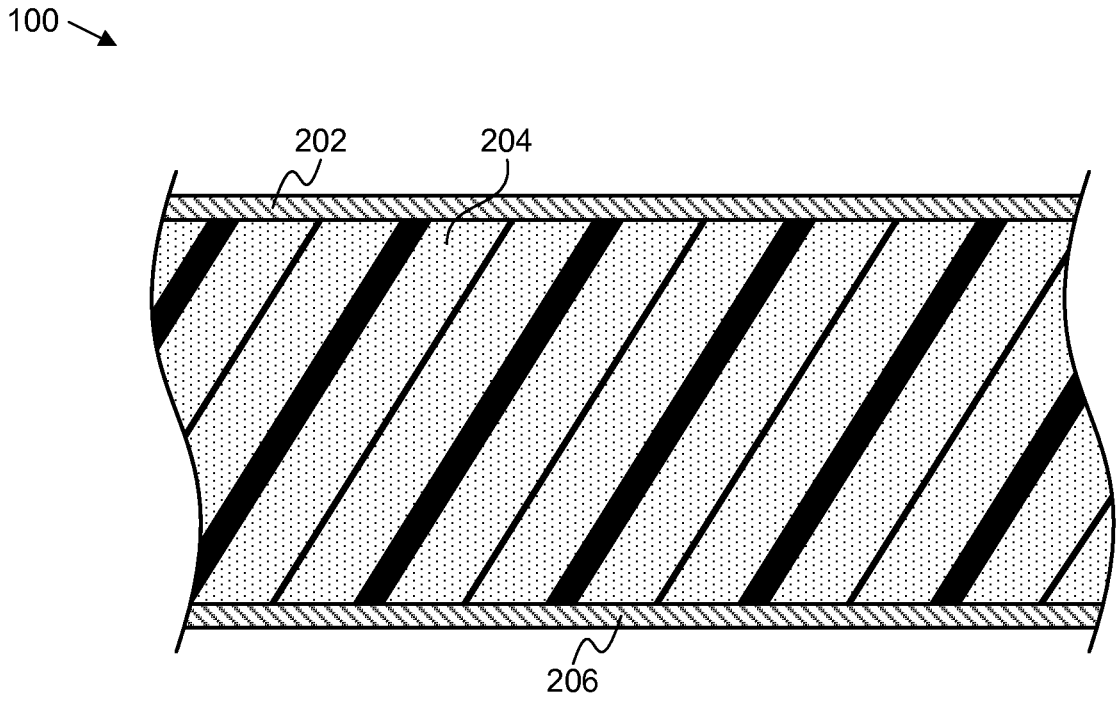
FIG. 2 is a cross-sectional side view of a section of the article of apparel of FIG. 1.

FIG. 2 depicts a layered composition for the article of apparel 100 of FIG. 1, in a cross section view. In the depicted embodiment, the article of apparel 100 includes a shell layer 202 and an insulation layer 204. In some embodiments, the article of apparel 100 further includes an inner lining layer 206. In another embodiment, however, the article of apparel 100 does not include the inner lining layer 206.

In certain embodiments, an article of apparel 100 may include additional materials not shown in FIG. 2. For example, if the article of apparel 100 is formed as a glove, it may include a palm area reinforced with leather or other gripping material. Similarly, an article of apparel 100 formed as a jacket may include snaps, zippers, or other fasteners, a drawstring, pockets, or the like. In light of this disclosure, it is clear that in various embodiments, an article of apparel 100 may include various other materials, in addition to the shell layer 202 and the insulation layer 204, as well as the inner lining layer 206 in certain embodiments.

As used herein, directional words such as "inner," "outer," "up," "down," "upper," "lower," "horizontal," "vertical," "left," "right," and the like, refer to the article of apparel 100 as worn by a standing user. Thus, for example, an "inner" layer would be closer to a wearer's skin than an "outer" layer, and the waist opening in a pair of pants would be "above" the foot openings. These terms are used, where applicable, to provide some clarity of description when dealing with relative relationships. But, these terms are not intended to imply absolute relationships, positions, and/or orientations. For example, with respect to an article of apparel 100 such as a pair of pants, a "front" surface can become an "upper" surface if the wearer simply lies down on his or her back. Nevertheless, it is still the same article of apparel 100.

In general, a temperature and humidity gradient across the article of apparel 100, caused by the wearer's body heat, drives moisture away from the wearer's body toward the outside of the article of apparel 100. In certain embodiments, the shell layer 202 is made from a breathable material. A breathable shell layer 202 provides moisture transferability from the article of apparel 100 into the surrounding environment. In a further embodiment, the shell layer 202 also may be made from a wind-resistant or windproof material. A wind-resistant (or windproof), breathable shell layer 202 allows the article of apparel 100 to dry out (or to remain dry), while retaining body heat and limiting the effects of evaporative cooling that could be caused by wind penetration through the shell layer 202.

In some embodiments, the shell layer 202 may be formed from a fabric material. For example, in one embodiment, the shell layer 202 may be made from a fabric such as polyester taffeta, nylon taffeta, ripstop nylon, or the like. For example, in one specific embodiment, the fabric of the shell layer 202 is the fabric specified by 100% Polyester Micro Taffeta, Anti-static, 180×13/50 D×50 D, 100 gm/yd, 59/60". In another embodiment, the shell layer 202 may include another, similar fabric. In some embodiments, the shell layer 202 may include wind-resistant, breathable material other than a fabric-type material. In light of this disclosure, it is clear that other materials and combinations of materials are suitable for use as the shell layer 202 for the article of apparel 100.

In the depicted embodiment, the shell layer 202 is an outer layer of the article of apparel 100. In one embodiment, the shell layer 202 may be disposed over or attached to the outside of the insulation layer 204, as the outermost layer of the article of apparel 100. In another embodiment, however, another layer may be the outermost layer of the article of apparel 100, but the shell layer 202 may be disposed over the insulation layer 204, as one of the outer layers of the article of apparel 100. In a certain embodiment, the shell layer 202 may envelop the insulation layer 204, thus forming both an inner layer and an outer layer of the article of apparel 100. In various embodiments, a material, color, pattern, or the like may be selected for the shell layer 202 based on a wearer's desired appearance for the article of apparel 100. For example, in one embodiment the shell layer 202 may be brightly colored for worker safety. As a further example, in certain embodiments, the shell layer 202 may be white, for snow camouflage, or may include another camouflage pattern.

In one embodiment, the insulation layer 204 is made from a foam material. In a certain embodiment, the foam material of the insulation layer 204 may be an engineered polymer lining. The foam material of the insulation layer 204 provides breathability, while air trapped in the foam protects a user from extreme temperatures. In a further embodiment, the foam material of the insulation layer 204 may include open-cell foam. In one embodiment, the open cell foam may be fully reticulated, so that substantially all the faces of the foam cells are missing, leaving a very open, permeable structure of cell edges behind. In another embodiment, the open cell foam may not be fully reticulated, but may still have open, permeable cells in which some faces of the foam cells are missing, while other faces remain. As compared to closed cell foam, in which each cell of the foam structure is enclosed by its faces, open cell foam allows air and moisture to move among open cells in the structure of the foam. Thus, open cell foam is less water-resistant, but more breathable, than closed cell foam. Therefore, an insulation layer 204 including open cell foam may absorb moisture from near a wearer's body (e.g., through the inner lining layer 206) and allow the moisture to move more freely within the foam than within closed cell foam.

In certain embodiments, the wearer's body heat creates a temperature gradient within the foam, so that moisture within the foam moves away from the wearer, and may evaporate through the shell layer 202. Thus, the foam nearest the wearer may dry quickly, so that a wearer may feel insulated and warm even if the article of apparel 100 is not completely dry. In a further embodiment, even if the article of apparel 100 is saturated with moisture, by virtue of the temperature gradient created by the wearer's body heat and the open cell nature of the foam, moisture within the insulation layer 204 may move quickly enough for the wearer to be adequately warm in a short time period. Further, in certain implementations, the article of apparel can be squeezed to press out some excess water, which may facilitate a more rapid dispersing of the moisture near the wearer.

In one embodiment, the insulation layer 204 may include foam material with a moisture vapor transmission rate ("MVTR"), as measured using the ASTM Upright Cup test, of approximately 1,150 $g/m^2/24$ hrs. In another embodiment, the insulation layer 204 may include foam material with an MVTR in a range from approximately 900 $g/m^2/24$ hrs to approximately 1,200 $g/m^2/24$ hrs. (As used herein, a measurement is "approximately" equal to a stated value if it is within 10% of the stated value).

According to some embodiments, a thickness of the insulation layer 204 when uncompressed is within a range of approximately ¼ inch to approximately 1 inch. In light of this disclosure, it is clear that the insulation layer 204 may include various types of foam material at various thicknesses, which depend on the intended environment and application for the article of apparel 100, as well as a desired level of protection from cold or hot temperatures.

In one embodiment, foam material for the insulation layer 204 includes polyurethane foam. In a further embodiment, the polyurethane foam is flexible. In a certain embodiment, the insulation layer 204 includes flexible polyurethane foam produced by restricted expansion foaming. Flexible polyurethane foam produced by restricted expansion foaming is generated by polymerization in a pressurizable chamber at a pressure sufficient to prevent the foam from completely filling the chamber. Embodiments of restricted expansion foaming, and of flexible polyurethane foam produced thereby, are described in U.S. Pat. No. 4,777,186 to John W. Stang et al., entitled "Restricted expansion foaming and the flexible polyurethane foam thereby produced," issued Oct. 11, 1988, which is incorporated herein by reference in its entirety.

Foams produced by restricted expansion foaming exhibit useful properties, including a high indentation load deflection ("ILD") to density ratio. ILD refers to the firmness of a foam, determined by measuring the back force that a sample of the foam will exert against a compression plate as per ASTM 3574. Because compressing a foam pushes air out of the cells of the foam, a compressed foam may not insulate as well as an uncompressed foam. However, foam material in an insulation layer 204 of an article of apparel 100 may often be compressed if the wearer is sitting down, leaning against an object, bending an arm or leg during physical activity, or the like. Thus, in some embodiments, the insulation layer 204 includes foam material with a high ILD, which will rapidly return to an uncompressed (and better insulating) state. However, many high ILD foams also have high densities, resulting in heavy, or possibly uncomfortable, articles of apparel 100. Thus, in certain embodiments, the insulation layer 204 includes a foam with a high ILD to density ratio. In some embodiments, the insulation layer 204 includes a foam produced by restricted expansion foaming, with a high ILD to density ratio, while in other embodiments, the foam may be produced in another way, but may still include useful ILD and density properties.

In one embodiment, the insulation layer 204 may include foam material with an ILD within a range from approximately 10.0 lbs/50 $in^2$ to approximately 32.0 lbs/50 $in^2$ (at 25% deflection of a 4" thick sample). In a certain embodiment, the insulation layer 204 may include foam material with a density within a range from approximately 1.1 $lbs/ft^3$ to approximately 1.65 $lbs/ft^3$. In a further embodiment the insulation layer 204 may include foam material allowing an air flow within a range from approximately 2.6 $ft^3/min$ to approximately 4.8 $ft^3/min$ (through a 2"×2"×1" foam sample at 0.5-inch water pressure differential).

Some embodiments of an article of apparel 100 also include an inner lining layer 206. In the depicted embodiment, the inner lining layer 206 is an inner layer of the article of apparel 100, and the insulation layer 204 is disposed between the inner lining layer 206 and the shell layer 202. The article of apparel 100 may include the inner lining layer 206 to contain the foam material of the insulation layer 204, and/or for the wearer's comfort, so that foam is not worn directly against the skin or an undergarment. Because moisture transfer away from the wearer and through the foam keep the wearer dryer and warmer, the inner lining layer 206 should not unduly restrict the flow of moisture from the wearer to the insulation layer 204. Accordingly, in some embodiments, the inner lining layer 206 has an MVTR that is higher than the MVTR of the insulation layer 204. In various embodiments, the inner lining layer 206 may include ventilated, breathable and/or wicking fabrics, such as nylon or polyester mesh, tricot knit, or the like. In light of this disclosure, it is clear that many types of comfortable and/or breathable material may be used for the inner lining layer 206.

In various embodiments of an article of apparel 100, each of the various layers, such as the shell layer 202, the insulation layer 204, and the inner lining layer 206, may be attached to an adjacent layer, detachably connectable with an adjacent layer, or a combination of the above. For example, in one embodiment, the inner lining layer 206 may be attached to the insulation layer 204 by sewing, while the shell layer 202 may include a detachably connectable layer that may be worn as an outer layer with the combined insulation and lining layers, or may be detached and worn as a separate windbreaker. As another example, in another embodiment, the shell layer 202, the insulation layer 204, and the inner lining layer 206 may be quilted together. Stitching through the layers, or quilting, may, in certain embodiments, prevent the layers from shifting relative to each other, and keep the insulation layer 204 in place in the article of apparel 100. In a further embodiment, the shell layer 202, the insulation layer 204 and the inner lining layer may be quilted together with one or more additional layers, such as the fire protection layer described below with regard to FIG. 3.

Figure 3:
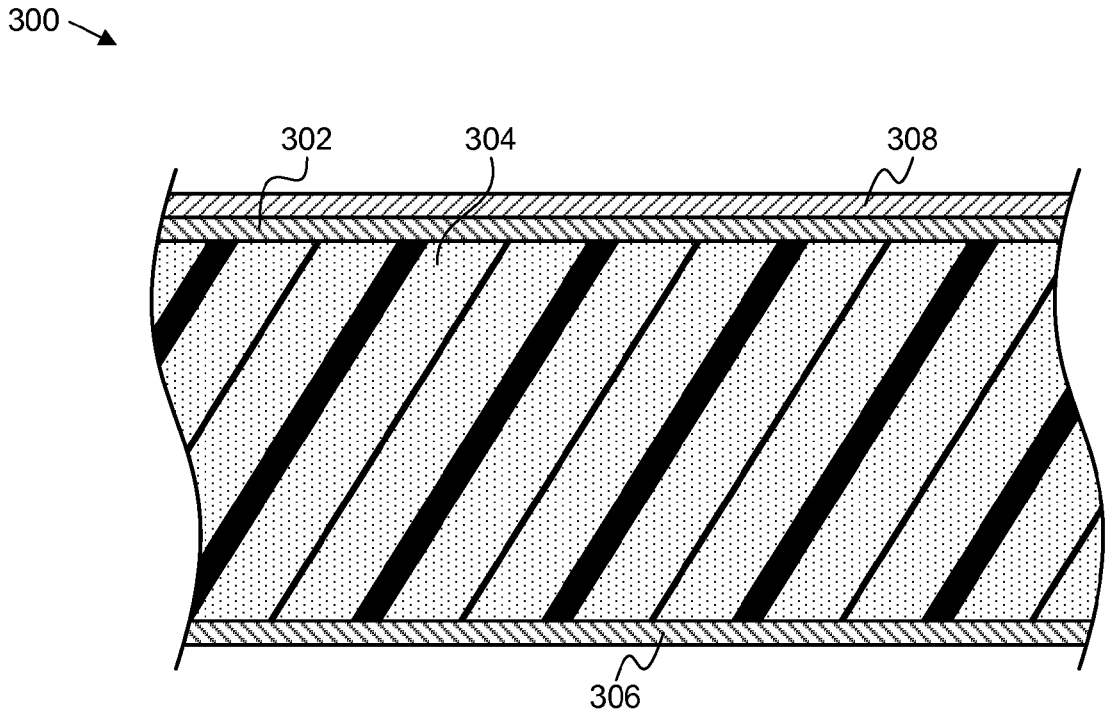
FIG. 3 is a cross-sectional side view of a section of another article of apparel according to another embodiment.

FIG. 3 depicts another embodiment of an article of apparel 300 including a shell layer 302, an insulation layer 304, and an inner lining layer 306 substantially as described above with reference to FIG. 2, with like numbers referring to like elements. In the depicted embodiment, the article of apparel 300 also includes a fire protection layer 308. In various embodiments, the fire protection layer 308 may include fire retardant, heat resistant, and/or flameproof material.

The article of apparel 300 may include the fire protection layer 308 to protect the wearer from fire. For example, in certain embodiments, the article of apparel 300 with a fire protection layer 308 may be useful for oil rig workers, or for cold weather firefighting. Although, in the depicted embodiment, the fire protection layer 308 is depicted as separate from the other layers, in another embodiment, the fire protection layer 308 may replace another layer. For example, in one embodiment, a windproof but breathable fire protection layer 308 may be a durable outer shell, replacing the shell layer 302. In another embodiment, a more breathable fire protection layer 308 may be worn as an undergarment, or in place of the inner lining layer 306. In a further embodiment, the fire protection layer 308 may encase the insulation layer 304, replacing both the shell layer 302 and the inner lining layer 306.

In one embodiment, the fire protection layer 308 may include oxidized polyacrylonitrile fibers, such as those in the flame-resistant or flame-retardant fabrics sold under the CarbonX trademark. In another embodiment, the fire protection layer 308 may include aramid fibers, such as those in the flame-resistant material sold under the Nomex trademark. In yet another embodiment, the fire protection layer 308 may include materials suitable for extreme heat, such as texturized fiberglass, vermiculite, aluminized materials, or the like. In light of this disclosure, it is clear that in various embodiments, many different materials are suitable for the fire protection layer 308.

Figure 4:
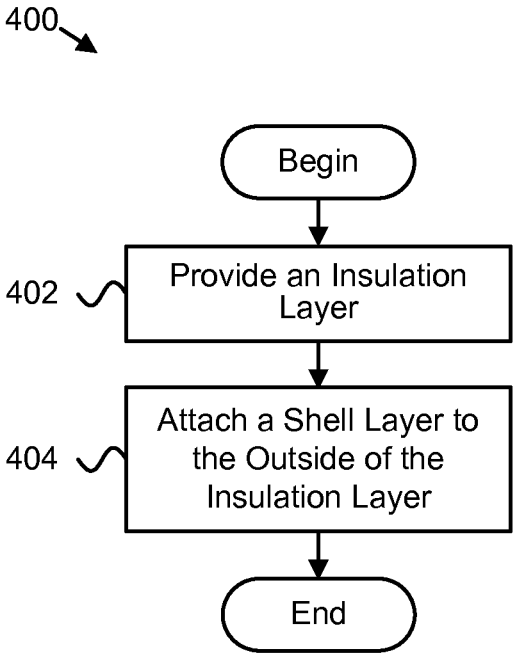
FIG. 4 is a schematic flow diagram illustrating one embodiment of a method for manufacturing an article of apparel.

FIG. 4 depicts a schematic flow diagram of a method 400 for manufacturing an article of apparel. The method 400 begins and an insulation layer 204, 304 is provided 402 for an article of apparel. In some embodiments, the insulation layer 204, 304 may include flexible polyurethane foam. In further embodiments, the flexible polyurethane foam may be generated by polymerization in a pressurizable chamber at a pressure sufficient to prevent the foam from completely filling the chamber. In certain embodiments, cells of the foam may trap air and allow moisture transfer through the insulation layer 204, 304. A shell layer 202, 302 is attached 404 to the outside of the insulation layer, and the method 400 ends. In certain embodiments, the shell layer 202, 302 comprises wind resistant, breathable material.

Although some of the embodiments of insulating material disclosed herein have been described as being operable with a system of apparel, it is recognized that embodiments of the present disclosure may also be operable in other types of systems. For example, insulating hot pads, though not worn as apparel, may protect a user from burns while holding hot objects.

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the subject matter of the present disclosure, however, absent an express correlation to indicate otherwise, an implementation may be associated with one or more embodiments.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The present subject matter may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An article of apparel comprising:

an insulation layer comprising a flexible, open cell, polyurethane foam, the foam generated by polymerization in a pressurizable chamber at a pressure sufficient to prevent the foam from completely filling the chamber;

a shell layer comprising wind resistant, breathable material, the shell layer comprising an outer layer of the article of apparel; and an inner lining layer, wherein the insulation layer is disposed between the inner lining layer and the shell layer;

wherein a thickness of the insulation layer when uncompressed is within a range of approximately ¼ inch to approximately 1 inch;

wherein a moisture vapor transmission rate ("MVTR") of the insulation layer is in a range from approximately 900 $g/m^2/24$ hrs to approximately 1,200 $g/m^2/24$ hrs;

wherein the article of apparel is one of a jacket, pants, handwear, a hat, a sock, and footwear; and wherein:

the jacket comprises a torso portion, configured to cover a torso of a user, and two sleeves, configured to cover the arms of the user, the torso portion and the two sleeves comprising the insulation layer and the shell layer;

the pants comprise two leg-holes, each configured to cover a leg of the user, the leg-holes each comprising the insulation layer and the shell layer;

the handwear comprises a finger portion, configured to cover fingers of the user, the finger portion comprising the insulation layer and the shell layer;

the hat comprises a head portion, configured to partially cover a head of the user, the head portion comprising the insulation layer and the shell layer;

the sock comprises a foot portion, configured to cover a foot of the user, the foot portion comprising the insulation layer and the shell layer; and the footwear comprises an upper portion, configured to cover the foot of the user, the upper portion comprising the insulation layer and the shell layer.

2. The article of apparel of claim 1, wherein the inner lining layer comprises mesh fabric.

3. The article of apparel of claim 1, wherein the inner lining layer, the insulation layer, and the shell layer are quilted together.

4. The article of apparel of claim 1, wherein a moisture vapor transmission rate ("MVTR") of the insulation layer is approximately 1,150 $g/m^2/24$ hrs.

5. The article of apparel of claim 1, wherein an indentation load deflection ("ILD") of the insulation layer is in a range from approximately 10.0 $lbs/50\ in^2$ to approximately 32.0 $lbs/50\ in^2$.

6. The article of apparel of claim 1, wherein a density of the insulation layer is in a range from approximately 1.1 $lbs/ft^3$ to approximately 1.65 $lbs/ft^3$.

* * * * *